US011337511B2

(12) United States Patent
Stollberg

(10) Patent No.: US 11,337,511 B2
(45) Date of Patent: May 24, 2022

(54) PAINTBRUSH WITH A SNAP CONNECTION

(71) Applicant: Arndt-Wilhelm Stollberg, Bad Lauterberg (DE)

(72) Inventor: Arndt-Wilhelm Stollberg, Bad Lauterberg (DE)

(73) Assignee: Arndt-Wilhelm Stollberg, Bad Lauterberg (DE)

( * ) Notice: Subject to any disclaimer, the term of this patent is extended or adjusted under 35 U.S.C. 154(b) by 152 days.

(21) Appl. No.: 16/792,062

(22) Filed: Feb. 14, 2020

(65) Prior Publication Data

US 2020/0260854 A1 Aug. 20, 2020

(30) Foreign Application Priority Data

Feb. 15, 2019 (DE) ..... 20 2019 100 868.7

(51) Int. Cl.

| | |
|---|---|
| ***A46B 7/04*** | (2006.01) |
| ***A46B 3/16*** | (2006.01) |
| ***A46B 5/00*** | (2006.01) |
| ***A46B 9/02*** | (2006.01) |
| ***A46D 1/00*** | (2006.01) |

(52) U.S. Cl.

CPC ..... *A46B 7/042* (2013.01); *A46B 3/16* (2013.01); *A46B 5/0095* (2013.01); *A46B 9/025* (2013.01); *A46D 1/0207* (2013.01); *A46B 2200/202* (2013.01)

(58) Field of Classification Search

CPC ..... A46B 3/16; A46B 5/0095; A46B 7/042

See application file for complete search history.

(56) References Cited

U.S. PATENT DOCUMENTS

| | | | | |
|---|---|---|---|---|
| 4,754,516 | A | 7/1988 | Tremblay | |
| 10,835,023 | B2 * | 11/2020 | Leebow | A46B 9/021 |
| 2010/0071145 | A1 | 3/2010 | Bryne | |
| 2015/0065927 | A1 | 3/2015 | Brewer | |

(Continued)

FOREIGN PATENT DOCUMENTS

| | | |
|---|---|---|
| AT | 009729 U1 | 3/2008 |
| DE | 304746 | 6/1917 |
| DE | 408237 A1 | 1/1925 |

(Continued)

OTHER PUBLICATIONS

International search report for 20152375.0-1113, dated Apr. 24, 2020.

*Primary Examiner* — Shay Karls

(74) *Attorney, Agent, or Firm* — Thomas | Horstemeyer, LLP

(57) ABSTRACT

The new paintbrush (19) includes a brush handle (1), a bristle carrier (11) and a ferrule (15). The brush handle (1) has a first end (3) including a brush handle snap element (4). The bristle carrier (11) has a first front side (36) including a bristle carrier snap element (12), the bristle carrier snap element (12) engaging the brush handle snap element (4) such that the bristle carrier (11) is fixedly connected to the brush handle (1). The bristle carrier (11) includes a plurality of recesses (23) and a plurality of bristles (20), the bristles (20) being arranged to form a plurality of bristle bundles (24), the bristle bundles (24) each being arranged to be gluelessly fixed in one of the recesses (23). The ferrule (15) is designed as one piece with the bristle carrier (11).

12 Claims, 7 Drawing Sheets

(56) References Cited

U.S. PATENT DOCUMENTS

2017/0196349 A1 7/2017 Adorno

FOREIGN PATENT DOCUMENTS

| | | | |
|---|---|---|---|
| DE | 1085845 | | 7/1960 |
| DE | 1097948 | | 1/1961 |
| DE | 1866316 | | 1/1963 |
| DE | 7034873 | U | 9/1970 |
| DE | 7615196 | | 9/1976 |
| DE | 7704172 | | 5/1977 |
| DE | 7719160 | | 4/1978 |
| DE | 8324256 | | 12/1983 |
| DE | 000003713848 | A1 | 3/1988 |
| DE | 202005000893 | | 4/2005 |
| DE | 102012010709 | A1 | 5/2013 |
| DE | 202014101517 | U | 8/2015 |
| DE | 102016114900 | A | 2/2018 |

* cited by examiner

PAINTBRUSH WITH A SNAP CONNECTION

CROSS REFERENCE TO RELATED APPLICATIONS

This application claims priority to co-pending German Utility Model DE 20 2019 100 868.7 filed on Feb. 15, 2019 and entitled "Malerpinsel mit Rastverbindung".

FIELD OF THE INVENTION

The present invention generally relates to a paintbrush.

Paintbrushes are used for painting walls and ceilings and for all other purposes where a paint, an oil, a surface coating or something similar is applied to a surface.

Paintbrushes e.g. include whitewash brushes, flat brushes, round brushes, ring brushes and ceiling brushes as well as various paintbrushes for special purposes such as radiator brushes and facade brushes.

BACKGROUND OF THE INVENTION

German utility model DE 7 719 160 U1 discloses a brush having a handle. A protrusion is formed at the end of the handle. The protrusion includes a circumferential undercut portion. For attaining the brush, bristles are combined to a bristle bundle having the size of all bristles of the brush, and the bristle bundle is introduced into a ferrule. At its end opposite to the bristle bundle, the ferrule includes a circumferential snap protrusion. The ferrule with the bristle bundle can be pushed onto the protrusion resulting in the snap protrusion of the ferrule engaging the undercut portion.

German utility model DE 7 615 196 U1 discloses a brush including a plastic handle and a ferrule being made of sheet metal. A bristle bundle having the size of all bristles of the brush is fixedly cemented in the ferrule of sheet metal such that the ferrule of sheet metal and the bristle bundle form a brush head. The plastic handle at its one end includes at least one opening, while the ferrule of sheet metal includes a round impression acting as a locking cam. The locking cam or the locking cams of the ferrule of sheet metal may engage the opening or the openings when the ferrule of sheet metal is pushed onto the plastic handle. In this way, the ferrule of sheet metal is snapped on the plastic handle. The snap connection formed thereby is detachable to be able to replace the brush head.

German utility model DE 7 704 172 U1 discloses a brush including a handle and a ferrule. The ferrule surrounds one single bristle bundle forming all bristles of the brush and being cemented in the ferrule such that the ferrule and the bristle bundle form a brush head. The ferrule includes locking cams. The handle at its one hand includes a circumferential collar or a plurality of circumferential collars. The locking cams of the ferrule can engage this collar or these collars when the ferrule is pushed onto the handle such that the ferrule is snapped on the handle. The plurality of collars allows for pushing different ferrules having differently arranged locking cams onto the handle. Furthermore, the handle at its end, onto which the ferrule is pushed, includes a tapered protrusion including circumferential undercuts. This protrusion is intended to engage the cement holding the bristles and to improve the support of the bristles.

Another brush is known from German utility model DE 83 24 256 U1. The brush includes a brush handle, a bristle carrier and a ferrule. The bristle carrier and the ferrule are designed as one piece. For example, this may be a plastic injection molding component. This component includes bristle bundles being glued to the bristle carrier. The brush handle is designed to be a hollow such that the brush head base element is partly inserted into the brush handle such that it can be fixed there and be later removed.

SUMMARY OF THE INVENTION

The present invention relates to a paintbrush. The paintbrush includes a brush handle, a bristle carrier and a ferrule. The brush handle has a first end including a brush handle snap element. The bristle carrier has a first front side including a bristle carrier snap element, the bristle carrier snap element engaging the brush handle snap element such that the bristle carrier is fixedly connected to the brush handle. The bristle carrier includes a plurality of recesses and a plurality of bristles, the bristles being arranged to form a plurality of bristle bundles, the bristle bundles each being arranged to be gluelessly fixed in one of the recesses. The ferrule is designed as one piece with the bristle carrier.

In prior art brushes, the bristles are fixed in the ferrule. The ferrule provides some sort of sidewall into which the bristles are glued by glue or putty such that the bristles are arranged in a thick layer of glue or putty faces towards the brush handle, and it is possible that the brush handle engages the layer of glue or putty.

In contrast, the new bristle carrier is designed such that the bristles are arranged in the bristle carrier without glue. In contrast to the prior art, the bristles are not fixed in the ferrule, but they are arranged directly at or in the new bristle carrier. The ferrule may also be designated as a clamp or a holder. The bristle carrier forms some sort of bottom being entirely arranged between the bristles and the brush handle. This is a function that is fulfilled by glue or putty in the prior art brushes.

The bristle carrier may be made of a massive material, for example wood or plastic.

The bristles, especially when they are made of plastic, are also designated as "filaments". Such filaments are also meant when using the term "bristles".

The paintbrush has a longitudinal brush axis. In the simplest case, the longitudinal brush axis extends along the brush handle, through the bristle carrier and possibly parallel to a direction of extension of the bristles. There may be a deviation from this arrangement when the direction of extension of the bristles is not parallel to the brush handle. This may be the case in so called "radiator brushes" in which the brush handle is angled with respect to the direction of extension of the entirety of the bristles. In this case, a longitudinal brush axis may be defined by the bristle carrier. This axis then extends parallel to the direction in which the bristle carrier extends between the brush handle and the bristle bundles.

The ferrule at least partly surrounds the bristle carrier in relation to its extension along the longitudinal brush axis. The ferrule is designed as one piece with the bristle carrier. This considers the fact that the new ferrule does not have to fulfill the prior art function of surrounding the bristle and to hold the bristles. Thus, the ferrule does no longer have to be hollow.

Although the ferrule is designed as one piece with the bristle carrier, it may have the appearance of the ferrule of a prior art paintbrush as it has been described above. However, since the new ferrule does not serve to fixedly arrange the bristles, the ferrule may surprisingly be used for one or more new functions. However, the ferrule may also be present simply to adapt the appearance to the expectations of a user. A user of paintbrushes is used to the presence of a ferrule and may expect it. A ferrule may be present simply to fulfill these expectations of the user and to make a new paintbrush or a paintbrush including new components resemble a prior art paintbrush.

The ferrule may fully surround the bristle carrier in its extension along the longitudinal brush axis. In this case, the only exposed part of the bristle carrier is a bristle carrier surface at which the bristles may be arranged. An opposite surface of the bristle carrier being located at the place where the bristle carrier and the brush handle contact one another may be fully covered by the brush handle.

The ferrule may also surround the first end of the brush handle. The ferrule may additionally extend beyond the bristle carrier along the longitudinal brush axis. When the brush handle and the bristle carrier are snapped together, the brush handle in a sense extends into the ferrule.

The bristle carrier and the brush head base element may have various sizes and shapes. In a top view perpendicular to the longitudinal brush axis, the bristle carrier may be, for example, round, oval or rectangular or it may have a mixed shape, for example the one of a rectangle having rounded corners or bent sides. The bristle carrier may have any width, depth and thickness. The width of the bristle carrier may be, for example, between 20 mm and 90 mm, between 30 mm and 70 mm or between 50 mm and 70 mm. It is possible that a brush handle that is snapped together or is intended to be snapped together with a bristle carrier has a shape and/or size (width, depth/thickness) being adapted to the shape, size and/or length of the bristle carrier.

The brush handle may be especially made of wood.

The bristle carrier and the ferrule may be made of wood or plastic, for example.

The bristle carrier may have a bristle carrier surface having a convex shape. The convex bristle carrier surface may be designed in various ways. In case of a round bristle carrier, it may be shaped like a dome in the simplest case.

The bristles form a plurality of bristle bundles. The bristle carrier includes recesses in each of which a bristle bundle is held. In contrast to prior art paintbrushes having a snapped together brush head, not the entire arrangement of the bristles is formed by one single bristle bundle and the bores are also not fixed by the ferrule. The design of separate bristle bundles is advantageous since it results in openings and intermediate spaces being formed between the bristle bundles. These openings and intermediate spaces may hold liquid and may dispense this liquid in a dosed way. For example, a portion in which three intermediate spaces are arranged between the bristle bundles is formed between the portion in which the bristle bundles exit from the recesses and a portion in which the bristles diverge such that the bristle bundles begin to contact one another. These intermediate spaces serve as liquid reservoirs in which liquid coming from a container is stored and is slowly dispensed during painting with the paintbrush. In this application, the term of "liquid" is to be understood as including paints, lacquers, varnishes, glazes, oils and surface coatings.

The recesses—and thus the bristle bundles—may be arranged in a plurality of rows being located next to one another. The rows may extend straight. However, they may also extend curved.

The bristles and thus the bristle bundles may be designed to be bent in a U-shape. When the bristle bundles are bent in a U-shape, either the separate bristles are bent in a U-shape and subsequently combined to the bristle bundle, or the bristles are initially combined to the bristle bundles and then bent to the U-shape.

The term "bent in a U-shape" is intended to include slight deviations from the shape of a "U", for example a "V"-shape resulting from kinking of the bristles and the bristle bundles, respectively (i.e. "kinked in a V-shape"). Such slight deviations from the U-shape do not differ functionally from the U-shape.

The bristles and/or the bristle bundles may include bristle tips, a tip end being formed by the bristle tips, an opposite bending end and a longitudinal portion being arranged between the tip end and the bending end. Adjacent bristles and/or bristle bundles contact one another in a part of their longitudinal portions.

Bending of the bristles and/or the bristle bundles results in each bristle extending twice along the longitudinal portion. Thus, the bristle does not only include one portion being associated with the longitudinal portion between its two bristle tips, but instead two such portions. A portion is arranged between these—approximately in the center of the bristles—, the portion being bent in a U-shape and the portion being associated with the bending end of the bristles and/or of the bristle bundle.

Each bending end may be fixedly arranged in one of the recesses such that the bristle bundle is held in the recess in this way.

The statements contained in this application with respect to whether or not the bristles and bristle bundles contact one another refer to an unused and unloaded condition of the paintbrush. Contact of the bristle bundles means that at least one bristle of one of the bristle bundles and a bristle of one other of the bristle bundles contact one another. Typically, a plurality of bristles of the one bristle bundle will contact a plurality of bristles of the other bristle bundle. Bristles which are arranged in the center of the respective bristle bundle will likely not contact a different bristle bundle. Most of the bristles will each contact at least one other bristle of its own bristle bundle or of an adjacent bristle bundle.

Depending on their arrangement, the bristle bundles have a different number of adjacent bristle bundles. When, for example, the recesses and thus the bristle bundles are arranged on a square grid, the bristle bundles being located in the corners have two adjacent bristle bundles, the bristle bundles being located at the edges (not in the corners) have three adjacent bristle bundles and the bristle bundles being located in the grid have four adjacent bristle bundles. However, especially the bristle bundles being located at the edges or in the corners may include bristles which do not contact any other bristles in their longitudinal portion.

The statement that the bristles contact one another in their longitudinal portion does not necessarily mean that they have to contact one another along their entire longitudinal portion. The recesses have at least slight distances with respect to one another. This means that the bristle bundles at the place where they exit from a recess in which they are fixedly arranged have the diameter of the recess and thus are spaced apart from the adjacent bristle bundles in the same way as the associated recess is spaced apart from the adjacent recess. However, typically, the bristle bundles are strongly compressed for insertion into the recesses. This means that the bristles tend to diverge outside of the recess. This diverging of the single bristle bundle makes it possible that the adjacent bristle bundles contact one another.

The bristles may also contact one another in the region of the tip end. However, it is also possible that the bristles diverge such that they do not contact one another at the bristle ends. This may especially apply to bristles which do not contact any other bristles in their longitudinal portion. In both cases, the bristles may, however, form a closed arrangement of bristles. This means that the bristle tips are arranged to be at least substantially aligned and close to one another. They may contact one another, but do not have to contact one another. A closed bristle arrangement results in especially uniform liquid distribution.

The bristle tips may have a straight or a rounded surface in the region of the bristle arrangement. Single bristle tips may protrude from this. This may be caused by minor production inaccuracies, for example, by single bristles slightly getting out of place in their respective bristle bundle such that their two bristle tips are not aligned.

The paintbrush is suitable for an especially exact liquid distribution when the bristles are sharpened in the portion with which liquid is distributed. When the bristles are bent in a U-shape in the bristle bundles, this means for the new paintbrush that the bristles may be sharpened at their two bristle tips. Due to the U-shaped bending, the two sharpened bristle tips of each bristle are arranged in the region of the tip end. Since natural bristles at the most have one sharpened bristle tip due to the way they have grown, artificially produced bristles are especially suitable for the new paintbrush when it is desired that the bristles and/or the bristle bundles are bent in a U shape. Especially, the bristles may be sharpened mechanically or chemically at one bristle tip or at both of their bristle tips.

The bristles and the bristle bundles are gluelessly arranged in the recesses of the bristle carrier. Glue is to be understood as not only including glue as strictly speaking, but also putties and resins which are applied in a vicious condition and which then harden.

A plurality of fixing means may be provided to fix the bristles and/or the bristle bundles. The fixing means may be fixed at the bristle bundles by force fit and/or form fit, and they may be fixed at the bristle carrier by force fit and/or form fit. During the fixation process, the fixing means may enter into the respective recess in which the bristles and/or the bristle bundles are to be fixed.

It is possible that there is a plurality of anchoring wires. The bristles and/or the bristle bundles may be fixed in the bristle carrier by an anchoring wire being guided over (or through) the bending end of the bristle bundle and being anchored in the bristle carrier.

Some of the recesses may have an angle other than 0° with respect to the longitudinal brush axis. Generally, it is possible that all recesses have an angle other than 0° with respect to the longitudinal brush axis. However, it is also possible that only some recesses have such an angle or, in an extreme case, that only one recess has such an angle.

The recesses may at least have two angles other than 0° with respect to the longitudinal brush axis. Different angles are to be understood as angles having different absolute amounts.

For example, the recesses may be angled towards the outside such that the bristle bundles being inserted into the recesses slightly deviate. Such a deviation may occur at such a small measure that it is almost not perceptible. However, it is also possible that the bristle bundles deviate such that a perceptible split-up shape of the paintbrush is attained.

For example, the recesses may also be angled towards the inside such that the bristle bundles being inserted in the recesses strive slightly towards one another. In this way, the so called closure of the bristles and/or an especially smooth and/or fixed arrangement of the bristles can be attained. This may allow for an especially precise and dosed distribution of liquid.

The brush handle snap element as well as the bristle carrier snap element may include a connection protrusion or a connection recess. When the brush handle snap element and a bristle carrier snap element are associated with one another, especially one of the two snap elements (of the bristle carrier snap element and the brush handle snap element) may include the connection protrusion and the other one of the two snap elements may include the connection recess. In this case, when the bristle carrier and the brush handle are pushed are pushed upon one another, the connection protrusion may engage into the connection recess such that a connection between the bristle carrier and the brush handle can be attained. The connection protrusion and the connection recess may be part of a snap connection unit in this way.

The brush handle snap element as well as the bristle carrier snap element may include a snap protrusion or a snap recess. It is also possible that the bristle carrier snap element as well as the brush handle snap element each include a snap protrusion or each include a snap recess. For fulfilling the function of the brush handle snap element and of the bristle carrier snap element allowing for realizing the snap connection unit, it is only necessary that the snap protrusion and the snap recess each engage one another such that a first force is required for initiating engagement and thus for forming the snap connection unit and a second force is required for detachment and thus for opening the snap connection unit. The second force is greater than the first force.

When the snap protrusion or the snap recess is arranged at a connection protrusion, it may be designed to extend circumferentially. When the snap protrusion or the snap recess is arranged at a connection recess, it may be designed to be extend circumferentially at the connection recess. This means that the snap protrusion or the snap recess are also designed to extend circumferentially with respect to the longitudinal brush axis when the brush handle and/or the bristle carrier are part of a paintbrush. When, for example, a snap protrusion or the snap protrusion or a snap recess is designed to extend circumferentially, it is not necessary that the other snap protrusion or the snap recess or the other snap recess are also designed to extend circumferentially (and vice versa). It is possible that the snap protrusion and the snap recess or the snap protrusions or the snap recesses are brought into engagement with one another not along their entire extension to form the snap connection unit.

The brush handle may include a brush handle guiding surface. The brush handle guiding surface may be designed to extend circumferentially. This may mean that the brush handle guiding surface is designed to extend circumferentially about the longitudinal brush axis when the brush handle is part of a paintbrush.

The brush handle guiding surface and/or the brush head guiding surface may be designed to extend circumferentially about the longitudinal brush axis. Again, it is possible that a brush handle guiding surface (or a brush head guiding surface) only extending over a part of the circumference of the longitudinal brush axis cooperates with a brush head guiding surface (or with a brush handle guiding surface) being designed to extend circumferentially about the longitudinal brush axis.

The brush head base element may include a brush head guiding surface. The brush head guiding surface may be designed to extend circumferentially at the brush head guiding element. This may mean that the brush head guiding surface is designed to extend circumferentially about the longitudinal brush axis when the brush head base element is part of a paintbrush. However, the brush head guiding surface may also be arranged at the ferrule, the paintbrush guiding surface being designed to extend circumferentially at the ferrule. The brush head guiding surface may be especially arranged at the ferrule when the ferrule is designed as one piece with the bristle carrier. In this way, the ferrule surprisingly fulfills a new function.

When a paintbrush is formed by pushing the brush head and the brush head base element, respectively, onto the brush handle, the brush handle guiding surface and the brush head guiding surface may contact one another.

The brush handle guiding surface as well as the brush head guiding surface may be an outer guiding surface or an inner guiding surface. It is appropriate in case of two guiding surfaces being intended for engagement that one guiding surface is an outer guiding surface and the other guiding surface is an inner guiding surface. It is appropriate that either the brush handle guiding surface is an outer guiding surface and the brush head guiding surface is an inner guiding surface or the brush handle guiding surface is an inner guiding surface and the brush head guiding surface is an outer guiding surface.

Since the brush handle guiding surface and the brush head guiding surface contact one another, the brush handle and the brush head are secured against kinking due to forces transverse to the longitudinal brush axis. Such forces transverse to the longitudinal brush axis result in the brush handle guiding surface and the brush head guiding surface being pressed against one another. The fit of the brush handle guiding surface and the brush head guiding surface is preferably chosen such that there is no clearance or only a small clearance. In this way, the paintbrush is stabilized against loads acting transverse to the longitudinal brush axis as they occur during use of the paintbrush and which could lead to undesired detachment of the snap connection.

The brush handle guiding surface and the brush head guiding surface may also be designed such that they are stabilized against rotations due to rotational forces about the longitudinal brush axis. Such a stabilization function always occurs automatically when the brush handle guiding surface and the brush head guiding surface do not extend circularly in a projection into a plane being perpendicular to the longitudinal brush axis. Any other design in this plane, for example, oval, polygonal, especially square, stabilizes against a rotation about the longitudinal brush axis. In this case, the fit between the brush handle guiding surface and the brush head guiding surface is also chosen to be such that there is no clearance or only a small clearance.

The brush handle guiding surface may be arranged behind the brush handle snap element as seen from the first end of the brush handle. In this way, an especially stable connection of the brush handle and the brush head and the brush head base element, respectively, can be attained. This is because a first partial connection of the brush handle and the brush head is attained by the brush handle snap element being located at an extreme of the first end of the brush handle and by the brush head snap element of the snap connection element. In addition, this is achieved by a second partial connection of the brush handle and the brush head being attained remotely towards a second end of the brush handle by the brush handle guiding surface and the brush head guiding surface. In this way, the connection being supported at two spaced apart locations is especially stable against kinking.

The brush handle guiding surface may have a length in a direction measured parallel to the longitudinal brush axis of at least 10%, at least one quarter, at least one third, at least 40% or at least half of the height of the bristle carrier or of the brush head base element as seen in a direction parallel to the longitudinal brush axis.

The brush head guiding surface may have a length measured in a direction parallel to the longitudinal brush axis or a longitudinal brush head axis corresponding to the longitudinal brush axis of at least 10%, at least one quarter, at least a third, at least 40% or at least half of a height of the bristle carrier or of the brush head base element as seen in a direction parallel to the longitudinal brush axis or the longitudinal brush head axis.

Advantageously, the height of the brush head guiding surface may be chosen to correspond to the height of the brush handle guiding surface or, vice versa, the height of the brush handle guiding surface may be chosen to correspond to the height of the brush head guiding surface.

The brush handle guiding surface and the brush head guiding surface may contact one another at a length as measured parallel to the longitudinal brush axis which corresponds to one quarter of a height of the bristle carrier or of the brush head base element as measured parallel to the longitudinal brush axis.

The brush head guiding surface and the brush handle guiding surface can stabilize the brush handle and the brush head and the brush head base element, respectively, especially well against kinking the greater the height is, in relation to the entire height of the brush head base element or the bristle carrier, along which the brush head guiding surface and the brush handle guiding surface contact one another.

It is possible that the brush handle and the bristle carrier are only interconnected by form fit and/or force fit. The form fit and/or the force fit is then especially realized in the snap connection unit. Since the bristles and the bristle bundles, respectively, are fixed gluelessly, it is possible to realize a fully glueless paintbrush. This may be especially advantageous since the manufacturing process of the paintbrush is simplified. In addition, there are material savings since it is not necessary to handle chemicals, for example, a glue containing solvents, during manufacture. Also, a user of the paintbrush does not get in contact with chemicals or with a glue containing solvents, for example. Such a glueless paintbrush may be easily disposed and possibly recycled.

The new paintbrush is especially economically friendly when the brush handle is made of wood and the brush head base element is made of recycled plastic and these are interconnected without glue.

It may be advantageous when the brush handle and the bristle carrier are designed not to be detachable non-destructively. In this way, the danger of undesired detachment of the bristle carrier and/or the brush head base element and/or the brush head from another is eliminated or reduced.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
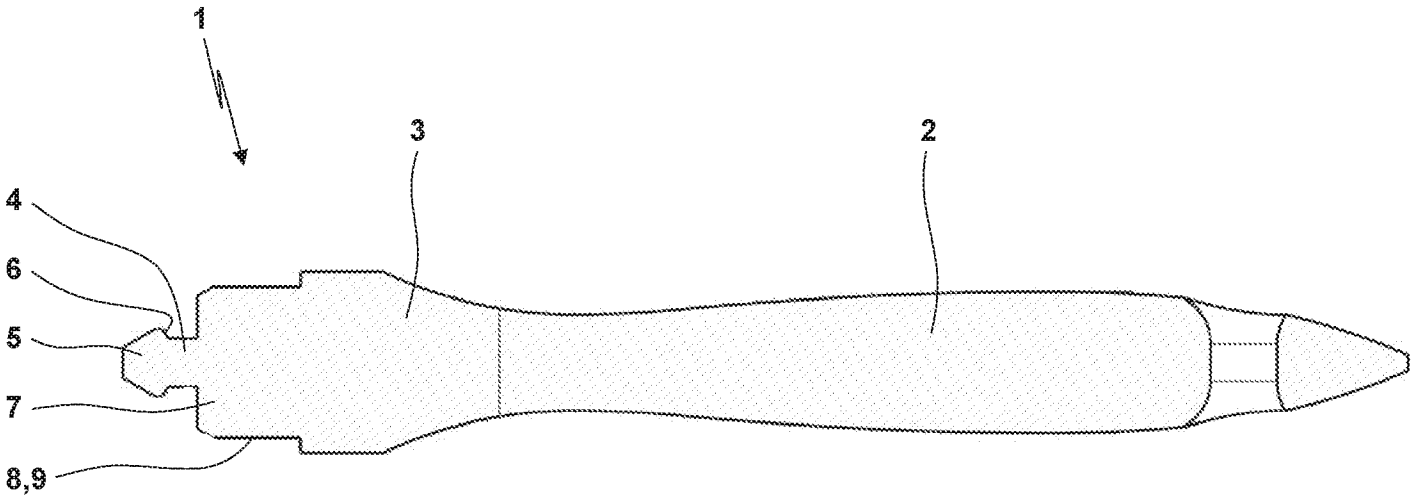
FIG. 1 illustrates a longitudinal sectional view of a first exemplary embodiment of a new brush handle.

Referring now in greater detail to the drawings, FIG. 1 illustrates a longitudinal sectional view of a brush handle 1. The brush handle 1 includes a gripping portion 2 which is designed ergonomically in this case. However, the brush handle 1 could also have any other common shape of a handle of a paintbrush.

A brush handle snap element 4 is located at a first end 3 of the brush handle 1. The brush handle snap element 4 includes a connection protrusion 5. The connection protrusion 5 has a shape as seen in a longitudinal sectional view which approximately corresponds to a isosceles trapezoid, a rectangle being connected to its longest side. The length of the side of the rectangle where it is connected to the trapezoid is smaller than the respective side of the trapezoid. In this way, a snap recess 6 is formed.

The snap protrusion 5 is arranged on a ledge 7 of the brush handle 1. The ledge 7 includes two parallel surfaces forming the brush handle guiding surfaces 8 and, in this case, being arranged laterally and being straight. The two surfaces may also be part of only one paintbrush guiding surface 8 extending about the handle brush 1. In the present case, the paintbrush guiding surface 8 is an outer guiding surface 9.

Figure 2:
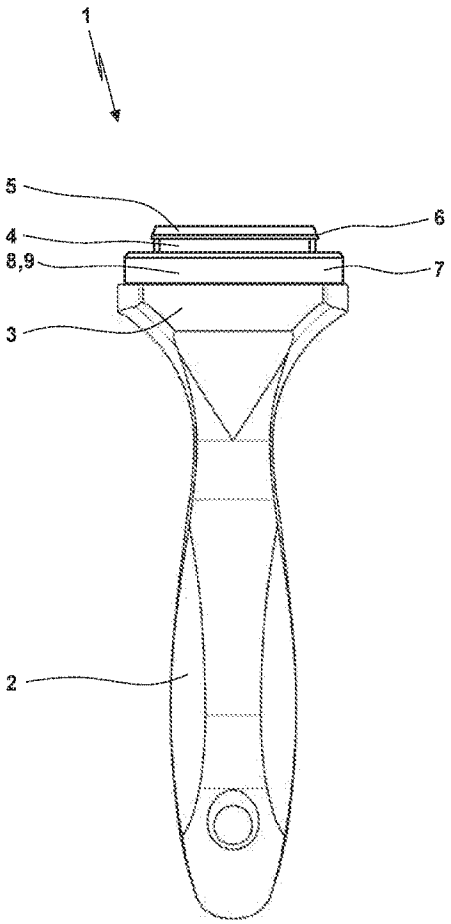
FIG. 2 illustrates a front view of the brush handle of FIG. 1.

FIG. 2 illustrates a front view of the brush handle 1. It is to be seen that the snap protrusion 6 in this embodiment extends about the connection protrusion 5 as well as the guiding surface 8.

Figure 3:
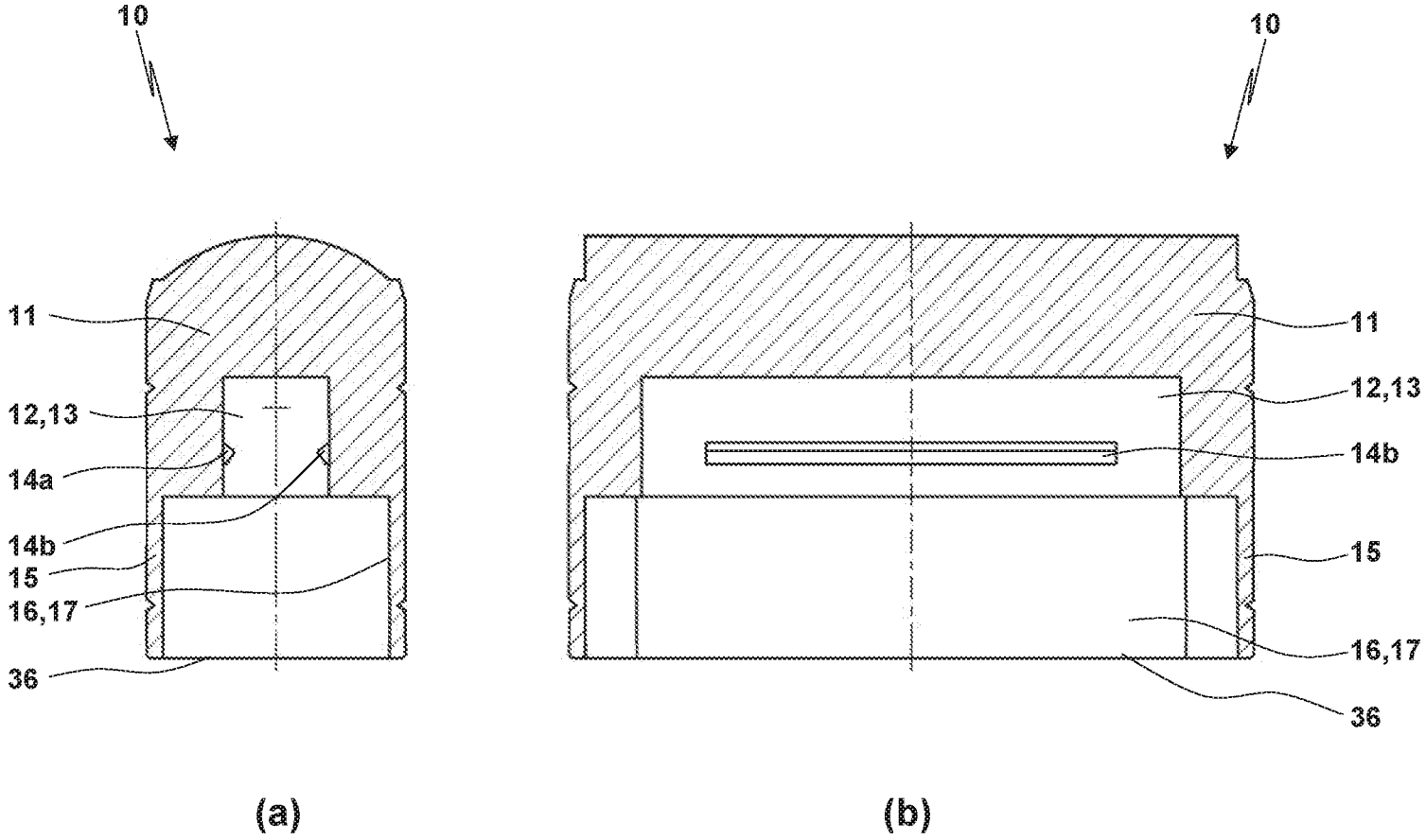
FIG. 3 illustrates a cross-sectional view and a longitudinal sectional view of a first exemplary embodiment of a brush head base element.

FIG. 3 (*a*) illustrates a cross sectional view and FIG. 3 (*b*) illustrates a longitudinal sectional view of a brush head base element 10. The brush head base element 10 includes a bristle carrier 11. The bristle carrier 11 at its first front side 36 includes a bristle carrier snap element 12 including a connection recess 13. In this case, the connection recess 13 is rectangular as seen in the cross section as well as in the longitudinal section. Furthermore, the bristle carrier snap element 13 includes a snap protrusion 14. In this case, the bristle carrier snap element 12 includes two snap protrusions 14*a*, 14*b* each extending at a side of the connection recess 13. The snap protrusions 14*a*, 14*b* face one another.

The brush head base element 10 also includes a ferrule 15 being arranged next to the bristle carrier 11 and being designed as one piece with the bristle carrier 11. The ferrule 15 is designated as such since its design corresponds to the one of ferrules of prior art paintbrushes. This may correspond to the desire of a user to maintain the traditional design despite the technical improvements. However, the ferrule 15 fulfills a different function than prior art ferrules. The ferrule 15 does not serve to hold a bristle bundle. Instead, the ferrule 15 surrounds the bristle carrier 11 with which it is designed as one piece. Apart from the bristle carrier 11, the ferrule 15 forms a brush head guiding surface 16 which, in this case, is designed as an inner guiding surface 17.

Figure 4:
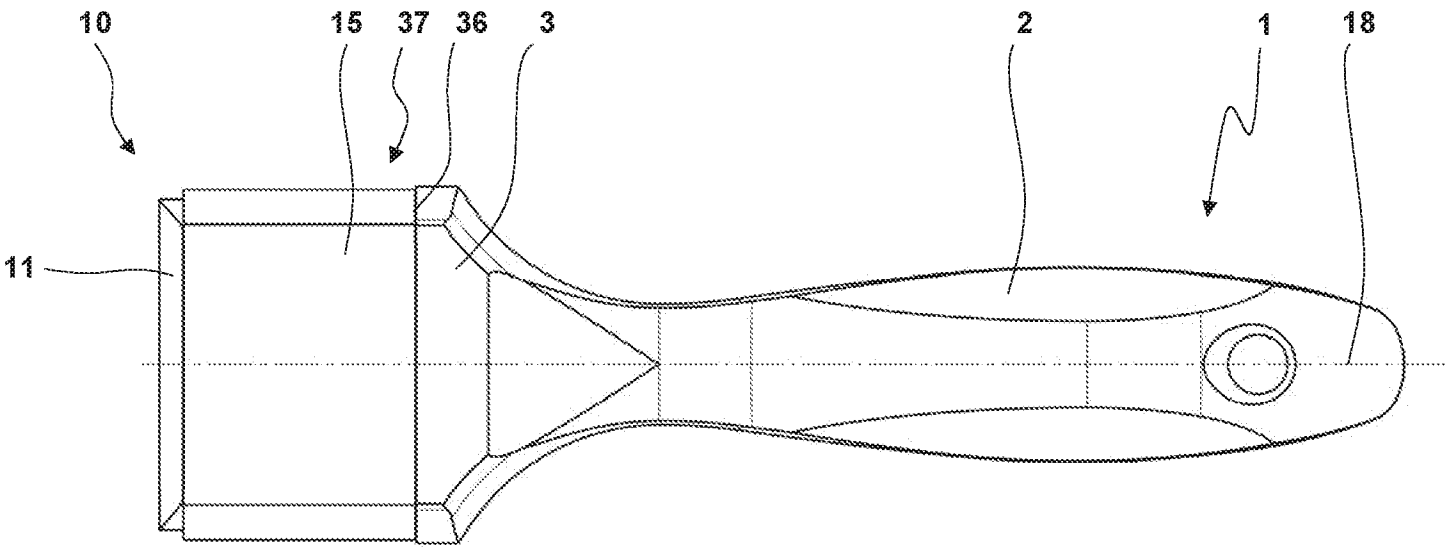
FIG. 4 illustrates a front view of the brush handle of FIG. 2 and of the brush head base element of FIG. 3, the brush head base element being slid upon the brush handle.

In FIG. 4, the brush head base element 10 is slid upon the brush handle 1 at its first end 3, the first front side 36 of the brush head base element 10 being aligned in a direction towards the first end 3 of the brush handle 1. The connection protrusion 5 of the brush handle 1 is inserted into the connection recess 13 of the brush head base element 10. At the same time, the brush handle snap element 4 engages the bristle carrier snap element 12. The snap recess 6 and the snap protrusion 14 engage one another in the sense of "tongue and groove" such that a snap connection unit 37 is formed by the brush handle snap element 4 and the bristle carrier snap element 12 due to engagement of the snap recess 6 and the snap protrusion 14. The snap connection being formed by the snap connection unit 37 cannot be disengaged none-destructively.

Furthermore, the brush handle guiding surface 8 and the brush head guiding surface 16 contact one another. In this way, guidance between the brush handle 1 and the brush head base element 10 is ensured. In this case, the guidance extends parallel to a longitudinal brush axis 18 due to the arrangement of the brush handle guiding surface 8 and the brush head guiding surface 16. The brush head base element 10 can only be slid upon (and possibly removed from) the brush handle 1 in a direction parallel to the longitudinal brush axis 18. The brush head base element 10 does not have a degree of freedom or at least only a small clearance with respect to the brush handle 1 in a direction transverse to a longitudinal brush axis 18. The brush handle guiding surface 8 and the brush head guiding surface 16 have an approximately rectangular shape as seen in a cross section perpendicular to the longitudinal brush axis 18. Consequently, the brush head base element 10 also does not have a rotational degree of freedom or at least only a small clearance in a rotational direction about the longitudinal brush axis 18 with respect to the brush handle 1.

While the snap connection being formed in the snap connection unit 37 between the brush handle snap element 4 and the bristle carrier snap element 12 prevents the brush head base element 10 being removed from the brush handle 1 along the longitudinal brush axis 18 bending and rotation.

Figure 5:
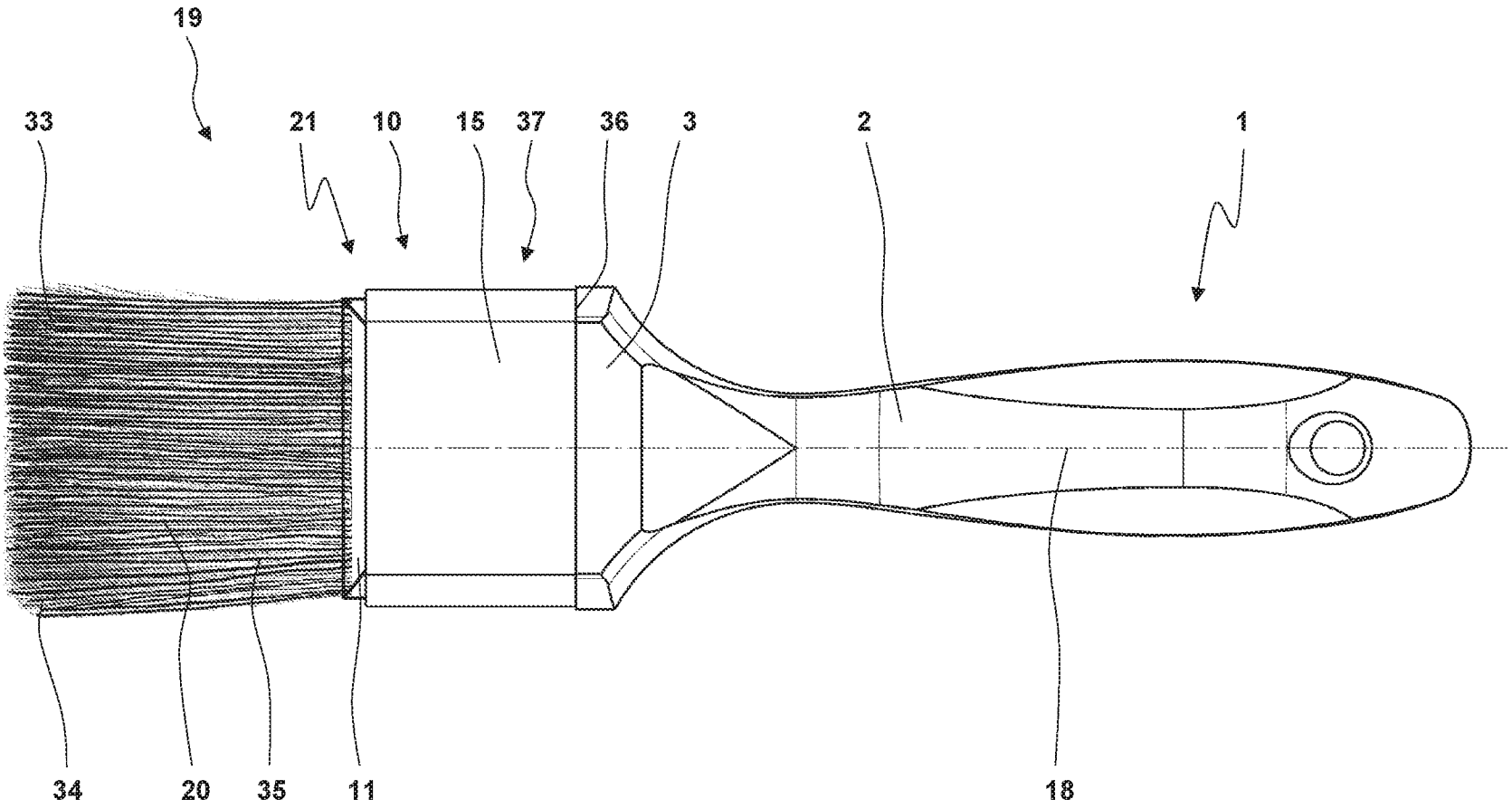
FIG. 5 illustrates a front view of a first exemplary embodiment of the new paintbrush including the brush handle of FIG. 2 and the brush head base element of FIG. 3.

FIG. 5 illustrates a paintbrush 19. The brush handle 1 and the brush head base element 10 correspond to the brush handle 1 and the brush head base element 10 of FIG. 5. In addition, the paintbrush 19 includes bristles 20 being arranged at the bristle carrier 11. The arrangement of the bristles 20 at the bristle carrier 11 is only schematically illustrated. A brush head 21 is formed by the brush head base element 10 and the bristles 20.

The paintbrush 19 has an appearance which is similar to prior art paintbrushes. This is especially because of the ferrule 15 being arranged between the brush handle 1 and the bristles 20 in a traditional way. In prior art paintbrushes, bristles are inserted into the ferrule, on the one hand, and the ferrule is snapped together with the brush handle, on the other hand. The new ferrule 15 does not fulfill these functions. The bristles 20 are held at or in the bristle carrier 11, and the bristle carrier 11 is snapped together with the brush handle 1. The ferrule 15 that has become free thereby, on the one hand, fulfills the optical function of the paintbrush 19 looking similar to a common paintbrush which may be possibly preferred by conservative users. On the other hand, the ferrule 15 also forms the brush head guiding surface 16.

The bristles 20 may be bent in a U-shape. The bristle tips 33 of which each bristle 20 has two are arranged to be substantially aligned. In case the bristles are not bent in a U-shape, they may each include only one bristle tip 33. The bristle tips 33 form the part of the paintbrush 19 which gets in contact with the surface to be painted during normal use of the paintbrush 19.

Figure 7:
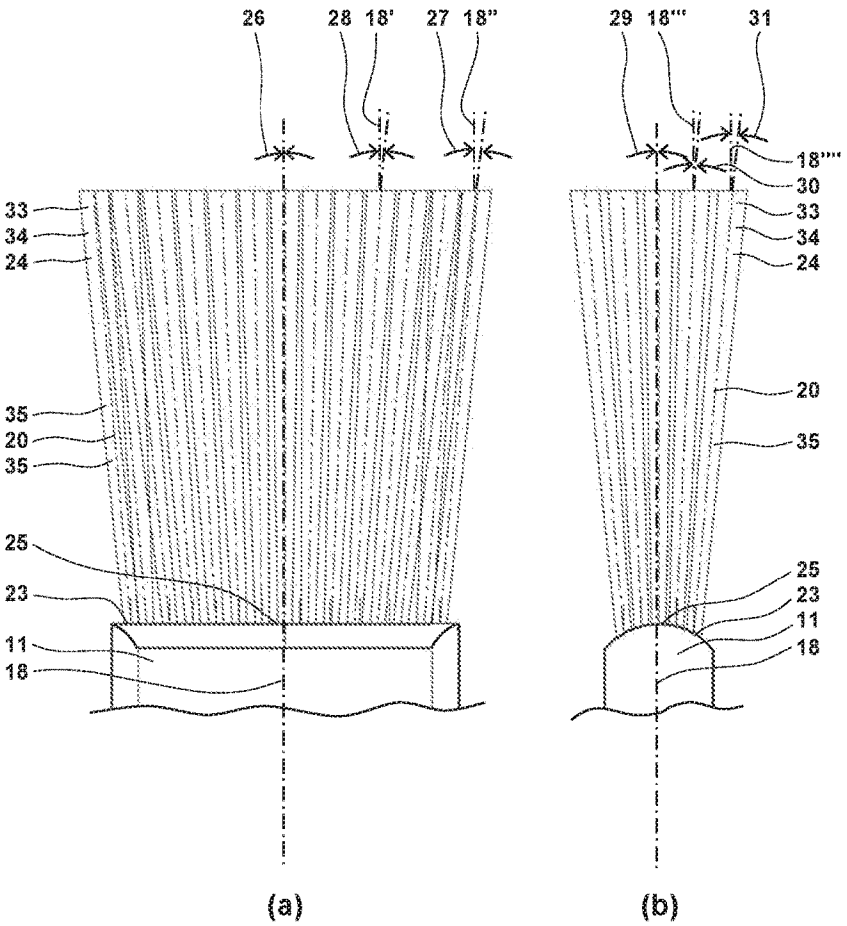
FIG. 7 illustrates a front view and a side view of a new bristle carrier with bristle bundles.

The bristles 20 may be combined to form bristle bundles 24 (see FIG. 7). In this case, a tip end 34 is formed by the bristle tips 33 for each bristle bundle 24 in which the bristle tips 33 are arranged. Opposite to the tip end 34, there is a bending end (not illustrated since it is covered by the bristle carrier 11) at the bristle bundle 24. The bending end is located where the bristles 20 are bent to be U-shaped. The bristle bundle 24 includes a longitudinal portion 35 between the tip end 34 and the bending end.

It is also indicated that the bristle tips 33, in this case, are not aligned, but a rounded bristle arrangement is realized.

Figure 6:
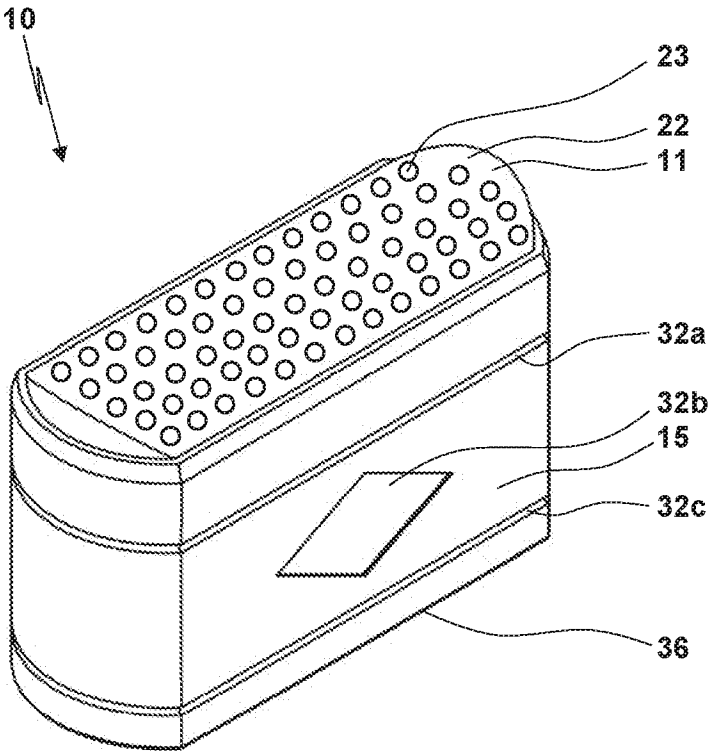
FIG. 6 illustrates a perspective view of a second exemplary embodiment of the new brush head base element as seen obliquely from above.

FIG. 6 illustrates a new brush head base element 10 in a perspective view obliquely from above. It is to be seen that the ferrule 15 is arranged to surround the bristle carrier 11. In this case, the ferrule 15 includes a plurality of decorative elements 32, as, for example, beads 32*a*, 32*c*. The decorative elements 32, especially when they are designed as beads 32*a*, 32*c*, may have a constructive function, for example a stabilizing function. However, the decorative elements 32 may also have a pure decorative function, for example, to make the ferrule 15 look like a prior art ferrule. This especially applies to a ferrule 15 being designed as one piece with the bristle carrier 11. A prior art ferrule is typically made of sheet metal or a band of plastic, and it includes beads for stabilization purposes.

Especially, a bristle carrier surface 22 of the bristle carrier 11 is exposed. The bristle carrier surface 22 is curved, in this case to be approximately barrel-shaped. An arrangement of recesses 33 as rows in the bristle carrier surface 22 is schematically illustrated.

FIG. 7 illustrates how the bristles 20 may be arranged at and in the bristle carrier 11. A front view (FIG. 7 (*a*)) and a side view (FIG. 7 (*b*)) of the bristle carrier 11 including the bristles 20 are illustrated. The bristles 20 are combined to form bristle bundles 24. Each bristle bundle 24 is arranged in a recess 23, especially with its bending end. When the recesses 23 are arranged in rows according to FIG. 6, the bristle bundles 24 are also arranged in rows. The bristle bundles 24 are only schematically illustrated.

The five bristle bundles 24 visible in FIG. 7 (*b*) each symbolize a row of bristle bundles 24. All other bristle bundles 24 of the respective row are covered by the visible bristle bundle 24. On the other hand, in the front view of FIG. 7 (*a*), only one row of bristle bundles 24 is visible. All other rows are covered by the visible bristle bundle 24.

The bristle bundles 24 and thus the bristles 20 as such do not extend to be parallel. Instead, the bristle bundles 24 are angled with respect to one another. The longitudinal brush axis 18 extends parallel to the brush handle 1 and to at least one bristle bundle 24. Usually, this is a bristle bundle 24 being arranged in the center or in a central portion 24 being arranged in the region of the center of the bristle carrier 11. However, it is also possible that the longitudinal bristle axis 18 only extends parallel to the brush handle 1 and not to any bristle bundle 24 or, conversely, that the longitudinal brush axis 18 extends parallel to a bristle bundle 24, but that the brush handle 1 is arranged at an angle. Usually, the longitudinal brush axis 18 extends parallel to the side walls of the ferrule 15 or parallel to an extension of the bristle carrier 11 between the brush handle 1 and the bristles 20. Illustrations of the longitudinal brush axis 18 being displaced in a parallel way are designated by the reference numerals 18', 18", 18''' and 18'''.

A first bristle bundle 24—in this case a bristle bundle being arranged in the central portion 25 of the paintbrush 19—has a first angle 26 of 0° with respect to the longitudinal brush axis 18. A second bristle bundle 24—being arranged furthermost to the central portion 25—has a second angle 27 with respect to the longitudinal brush axis 18" being greater than the first angle 26. The bristle bundles 24 being arranged between the first and the second bristle bundle 24 are also angled with respect to the longitudinal brush axis 18. As an example, a third angle 28 with respect to the longitudinal brush axis 18' is illustrated, the third angle 28 being formed by a third bristle bundle 24 being arranged between the first bristle bundle 24 and the second bristle bundle 24. The third angle 28 is greater than the first angle 26, but it is smaller than the second angle 27. The angles at which the bristle bundles 24 are arranged with respect to the longitudinal brush axis 18 increase with an increasing distance between the respective bristle bundles 24 and the central portion 24 of the bristle carrier 11.

The same situation may also be observed in the side view of FIG. 7 (*b*): A first bristle bundle 24 being arranged in the central portion 25 has an angle 29 of 0° with respect to the longitudinal brush axis 18. A second bristle bundle 24 being arranged further away from the central portion 25 in the direction towards an edge of the bristle carrier 11 has a second angle 30 with respect to the longitudinal brush axis 18''', the second angle 30 being greater than the first angle 29.

A third bristle bundle 24 being arranged furthermost to the central portion 25 has a third angle 31 with respect to the longitudinal brush axis 18''', the third angle 31 being greater than the first angle 29 and the second angle 30.

The angles 26-31 of the bristle bundle 24 increase with an increasing distance from the central portion 25. The angles 26-31 partly overlap since specific bristle bundles 24 are angled as illustrated in FIG. 7 (*a*) as well as they are angled as illustrated in FIG. 7 (*b*).

The tip ends 34 of all bristle bundles 24 and thus the bristle tips 33 of the bristles 20 (not being separately illustrated in FIGS. 7 (*a*), 7 (*b*) are aligned.

To attain the rounded arrangement of the bristle tips 33 according to FIG. 6, the recesses 23 may have approximately the same depth and an angle 26-31 as it has been described herein above with respect to the longitudinal brush axis 18. The rounded arrangement of the bristle tips 33 is caused by the bristle bundles 24 having the same length, the bristle bundles 24 being inserted in recesses 23 having the same depth and being arranged in the convex round shape of the bristle carrier 22 in combination with the recesses 23 having angles with respect to the longitudinal brush axis 18 which increase with an increasing distance with respect to the central portion 25.

Many variations and modifications may be made to the preferred embodiments of the invention without departing substantially from the spirit and principles of the invention. All such modifications and variations are intended to be included herein within the scope of the present invention, as defined by the following claims.

I claim:

1. A paintbrush, comprising:

a brush handle, the brush handle having a first end including a brush handle snap element;

a bristle carrier, the bristle carrier having a first front side including a bristle carrier snap element, the bristle carrier snap element engaging the brush handle snap element such that the bristle carrier is fixedly connected to the brush handle, the bristle carrier including a plurality of recesses and a plurality of bristles, the bristles being arranged to form a plurality of bristle bundles, the bristle bundles each being arranged to be gluelessly fixed in one of the recesses, the bristle carrier having a bristle carrier surface through which the bristles extend, the bristle carrier surface having a convex shape, the brush handle and the bristle carrier being designed and arranged such that they cannot be detached from one another non-destructively; and a ferrule, the ferrule being designed as one piece with the bristle carrier.

2. The paintbrush of claim 1, further comprising a longitudinal brush axis, wherein the ferrule is designed and arranged to surround the bristle carrier at least partly with respect to its extension along the longitudinal brush axis.

3. The paintbrush of claim 1, further comprising a longitudinal brush axis, wherein the ferrule is designed and arranged to fully surround the bristle carrier with respect to its extension along the longitudinal brush axis.

4. The paintbrush of claim 1, wherein the bristle bundles are bent to be U-shaped.

5. The paintbrush of claim 1, wherein the bristles have bristle tips, the bristle bundles have a tip end, a bending end and a longitudinal portion, the bending end being arranged opposite to the tip end, the longitudinal portion being arranged between the tip end and the bending end, the bristle bundles being designed and arranged such that adjacent bristle bundles contact one another in a part of their longitudinal portions.

6. The paintbrush of claim 5, wherein each bending end is fixedly arranged in one of the recesses of the bristle carrier.

7. The paintbrush of claim 6, further comprising a plurality of anchoring wires, each bristle bundle being fixedly arranged in one of the recesses of the bristle carrier by at least one of the anchoring wires, the anchoring wire extending through the bending end of the bristle bundle and being anchored in the bristle carrier.

8. The paintbrush of claim 1, further comprising a longitudinal brush axis, wherein some of the recesses of the bristle carrier have an angle other than 0° with respect to the longitudinal brush axis.

9. The paintbrush of claim 1, wherein the bristle carrier and the bristles are made of plastic.

10. The paintbrush of claim 1, wherein the bristle carrier and the bristles are made of recycled plastic.

11. The paintbrush of claim 1, wherein the brush handle snap element includes a connection protrusion and the bristle carrier snap element includes a connection recess.

12. A paintbrush, comprising:

a brush handle, the brush handle having a first end including a brush handle snap element;

a bristle carrier, the bristle carrier having a first front side including a bristle carrier snap element, the bristle carrier snap element engaging the brush handle snap element such that the bristle carrier is fixedly connected to the brush handle and such that the brush handle and the bristle carrier cannot be detached from one another non-destructively, the bristle carrier including a plurality of recesses and a plurality of bristles, the bristles being arranged to form a plurality of bristle bundles, the bristle bundles each being arranged to be gluelessly fixed in one of the recesses, the bristle carrier having a bristle carrier surface through which the bristles extend, the bristle carrier surface having a convex shape; and a ferrule, the ferrule being designed as one piece with the bristle carrier.

* * * * *